United States Patent [19]

Shelby et al.

[11] Patent Number: 4,901,406

[45] Date of Patent: Feb. 20, 1990

[54] TOWEL CLASP SYSTEM

[76] Inventors: Charles B. Shelby, 7228 Craig St.; Jack E. Everett, 7216 Craig St., both of Fort Worth, Tex. 76112

[21] Appl. No.: 319,731

[22] Filed: Mar. 7, 1989

[51] Int. Cl.[4] ..... A44B 21/00

[52] U.S. Cl. ..... 24/521; 24/3 M

[58] Field of Search ..... 24/521, 522, 3 J, 3 M, 24/3 R, 3 L, 351, 442, 306; 224/918, 252, 183, 268; 273/32 R, 32 B, 32 A

[56] References Cited

U.S. PATENT DOCUMENTS

| | | | |
|---|---|---|---|
| 262,190 | 8/1982 | Valiant . | |
| 479,934 | 8/1892 | Chamberlin | 24/522 |
| 706,522 | 8/1902 | Bryant | 24/521 |
| 769,875 | 9/1904 | Prentice | 24/521 |
| 1,068,270 | 7/1913 | Posner | 24/306 |
| 1,276,125 | 8/1918 | Sherburne et al. . | |
| 1,702,172 | 2/1929 | Rennie . | |
| 2,039,620 | 5/1936 | Bear | 24/521 |
| 3,585,693 | 6/1971 | Barnhardt | 24/522 |
| 3,638,284 | 2/1972 | Baker | 24/306 |
| 4,361,934 | 12/1982 | Darnell | 24/3 M |
| 4,403,366 | 9/1983 | Lucke | 24/442 |
| 4,520,536 | 6/1985 | Hata | 24/522 |
| 4,639,980 | 2/1987 | Peterson | 24/306 |

FOREIGN PATENT DOCUMENTS 0011159 of 1890 United Kingdom ..... 24/351

*Primary Examiner*—Victor N. Sakran

*Attorney, Agent, or Firm*—James E. Bradley

[57] ABSTRACT

A clasp is provided for gripping a towel, having a base with a planar surface, and a locking member pivotally carried by the base. The locking member has a gripping edge separated from the base by a clearance, and a handle movable relative to the base through an arc for adjusting the clearance between the base and the locking member. The clearance is maximized in a loading position with the handle at a first region along the arc allowing a small potion of the towel to be inserted between the planar surface of the base and the locking member. The clearance between the planar surface of the base and the gripping edge of the locking member is minimized in a clasping position with the handle in a second region along the arc for securing the towel between the gripping edge of the locking member and the planar surface of the base to prevent removal of the towel. Compression of the towel between the gripping edge and the planar surface of the base creates a force which acts on the gripping edge to bias the locking member in the clasping position.

5 Claims, 2 Drawing Sheets

Fig.1
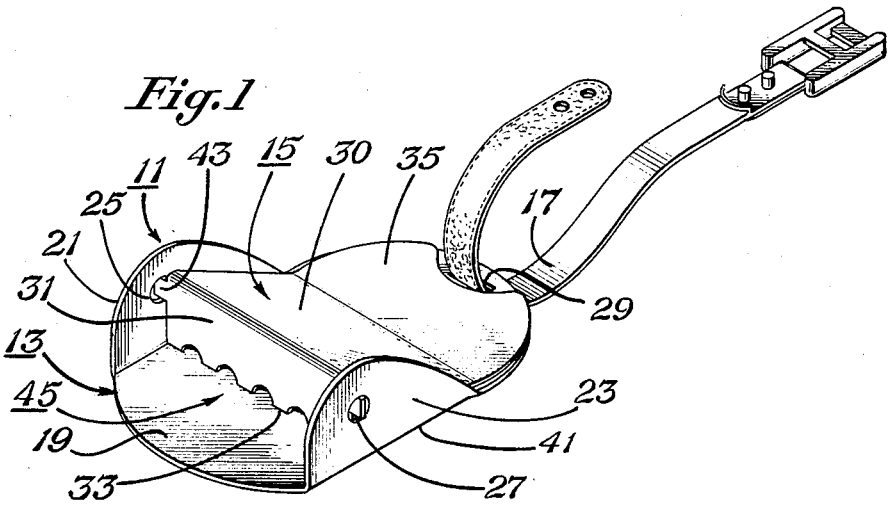
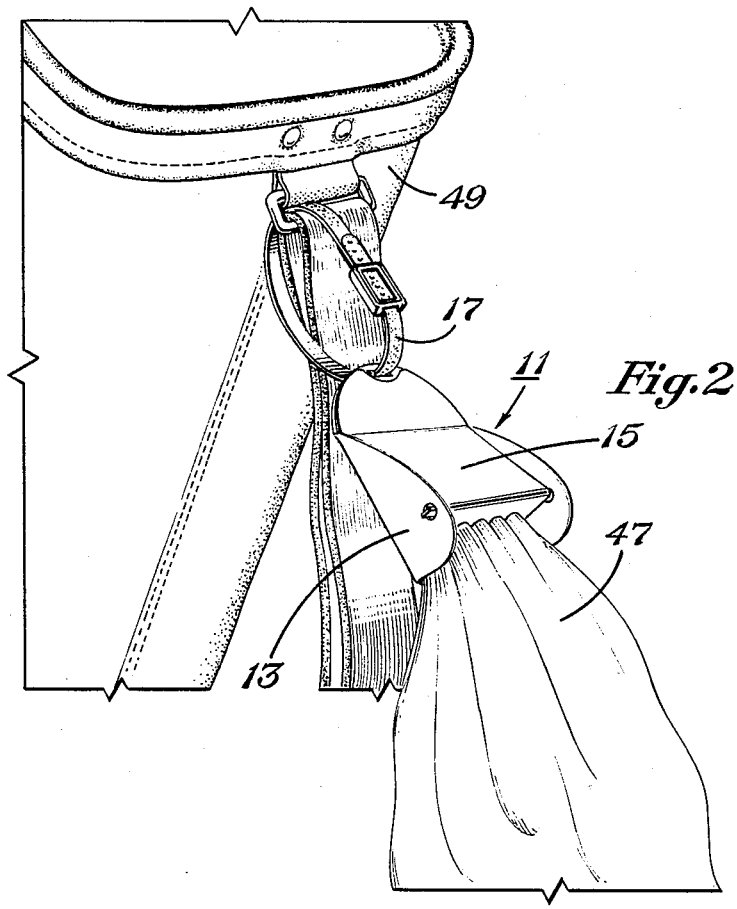
Fig.2

TOWEL CLASP SYSTEM

BACKGROUND OF THE INVENTION

1. Field of the Invention:

This invention relates generally to fasteners, and specifically to fasteners used for securing towels, and other articles of cloth.

2. Description of the Prior Art:

Hand towels are widely used in a variety of outdoor sporting and recreational activities for cleaning and drying hands and sporting equipment. For example, in the game of golf, it is important that the playing equipment, clubs and balls, remain dry and dirt-free, since dirt or water carried by either the club or the ball can introduce unwanted error into golf shots, reducing accuracy. In golf, it is also important that the player's hands be as dry as possible to enhance the grip and improve play.

While hand towels are useful for keeping the equipment in optimum condition, placement and storage of the towel can present an inconvenience. Carrying the hand towel about during play can cause distraction and discomfort, even if the towel is tucked into a pocket or draped over a shoulder. Frequently, the inconvenience and discomfort of carrying a hand towel discourages the practice of using hand towels during play.

Mechanisms have been devised to secure a hand towel in a preselected location. The current practice requires that the hand towel have an eyelet along one edge, adapted to receive a pin which serves to secure the hand towel to a golf bag or similar object. Of course, this approach requires that special towels with eyelets be provided, instead of ordinary hand towels. Such eyelets are subject to stress in ordinary operation due to the grasping and pulling of the hand towel by the user. Such stresses can result in a breach of the eyelet, requiring premature replacement of the towel. One additional disadvantage is inherent in this approach, namely the pin fastener requires a certain amount of time to secure and remove, presenting an inconvenience when the hand towel is removed from the golf bag or similar equipment.

SUMMARY OF THE INVENTION

It is therefore one object of the present invention to provide a hand towel clip which does not require that the hand towel be especially adapted with an eyelet along one edge, allowing ordinary hand towels to used instead.

It is another object of the present invention to provide a hand towel clip which serves to securely mount a hand towel in a desired location and minimize the possibility of the hand towel coming loose during normal use.

It is still another object of the present invention to provide a hand towel clip in which the hand towel may be removed and replaced with maximum ease and convenience.

It is yet another object of the present invention to provide a hand towel clip in which downward forces applied to the hand towel during normal use reenforce the grasping action of the clip to enhance stability.

It is still another object of the present invention to provide a hand towel clip with at least one substantially planar surface suitable for custom printing, rendering the hand towel clip useful as a speciality advertising item.

The preferred embodiment of the invention will now be described. A clasp is provided for gripping a towel, having a base with a gripping surface, and a locking member pivotally carried by the base. The locking member has a gripping edge separated from the base by a clearance, and a handle movable relative to the base through an arc for adjusting the clearance between the base and the locking member. The clearance is maximized in a loading position with the handle at a first region along the arc, allowing a small potion of the towel to be inserted between the planar surface of the base and the locking member. The clearance is minimized in a clasping position with the handle in a second region along the arc for securing the towel between the gripping edge of the locking member and the planar surface of the base to prevent removal of the towel. Compression of the towel between the gripping edge and the planar surface of the base creates a force which acts on the gripping edge to bias the locking member in the clasping position.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a perspective view of the clasp of the present invention coupled to a strap;

FIG. 2 is a perspective view of the clasp of the present invention in a clasping position gripping a towel, and attached to a golf bag through the strap;

DETAILED DESCRIPTION OF THE INVENTION

Figure 3:
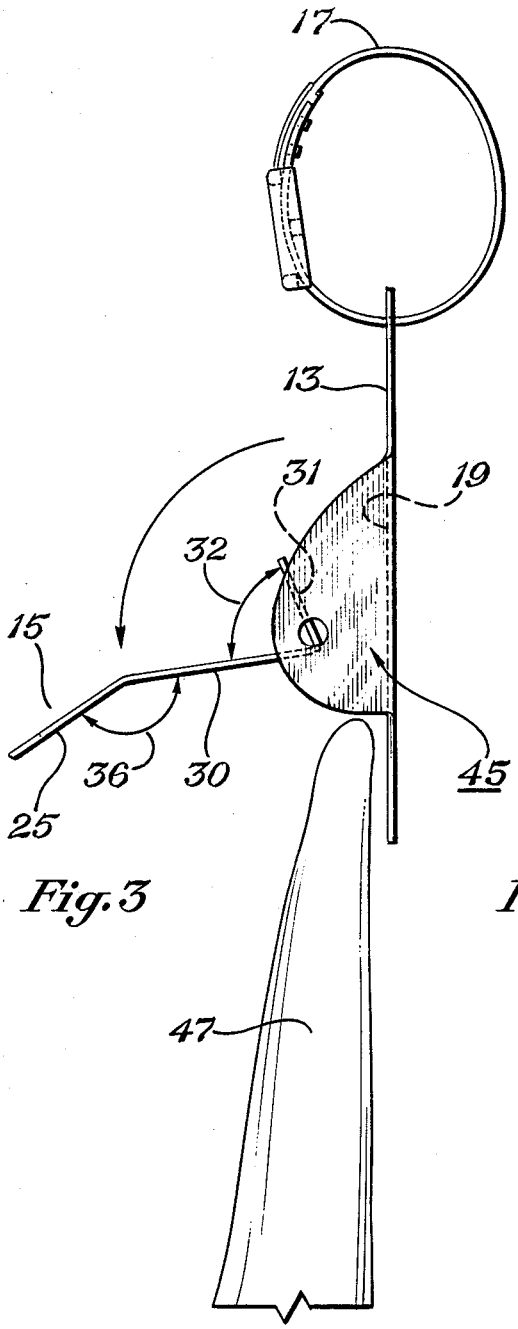
FIG. 3 is cross-section view of the clasp of the present invention in a loading position.

With reference now to the figures and in particular with reference to FIG. 1, clamp 11 includes base 13 and locking member 15 which cooperate to clasp towels. For purposes of this patent, the term "towel" includes items made of terry cloth, as well as other fabrics. In the preferred embodiment, clasp 11 may be secured to a selected object by tie strap 17, which is a conventional loop-type fastener, comprising a plastic strap having eyelets and pegs which interlock for closing the loop-type fastener.

In the preferred embodiment, base 13 includes substantially planar surface 19, and first and second flanges 21, 23 which are integrally formed with substantially planar surface 19 along each side, and substantially perpendicular to substantially planar surface 19. First and second apertures or bores 25, 27 are provided in first and second flanges 21, 23 respectively. First and second bores are aligned to define an axis traverse to substantially planar surface 19. A strap opening 29 is provided along the upper region of base 13, and is adapted for receiving strap 17.

In the preferred embodiment, locking member 15 includes a flat central section 30 and a gripping edge 31 is a first portion which. Gripping edge 31 forms an acute angle 32 (of FIG. 3) of about 80° relative to central section 30, which forms a second portion of the locking member 15. The gripping edge 31 is disposed between first and second flanges 21, 23 above substantially planar surface 19. Gripping edge 31 preferably forms a nonperpendicular angle 34 (of FIG. 4) with substantially planar surface 19, when locking member 15 is in the position of FIG. 1—identified as the closed or "clasping" position described below. Angle 34 is acute and is about 75° relative to planar surface 19. A plurality of gripping teeth 33 are disposed along the lower edge of gripping edge 31, but do not touch substantially planar surface 19. Rather, a clearance 45 is provided between gripping teeth 33 and substantially planar surface 19. As will be discussed in greater detail below, clearance 45 is variable depending upon the orientation of locking member 15 relative to base 13. The lower edges of the gripping teeth 33 are flat and parallel with the planer surface 19 when the locking member 15 is in the clasping position.

Locking member 15 is pivotally carried relative to base 13 by tabs 41, 43 which are disposed in first and second bores 25, 27 respectively. Locking member 15 is pivoted relative to base 13 by movement of a third portion or handle 35 which joins the central section 30. Handle 35 is simply a flat region adapted for manipulation by the human thumb and forefinger. Handle 35 is at an obtuse angle 36 (of FIG. 3) of about 150° relative to central section 30. As shown in FIG. 1, in the clasping position, handle 35 is substantially parallel with and pressed against an upper region of substantially planar surface 19. In the preferred embodiment, handle 35, central section 30, and gripping edge 31 are integrally formed from a single piece of metal, with sloped midsection 30 serving as a transition from the angular position of gripping edge 31 relative to base 13 and the parallel position of handle 35 relative to base 13. Of course, since locking member 15 is pivotal relative to base 13, it may be moved through a range of positions defined by an arc.

Figure 4:
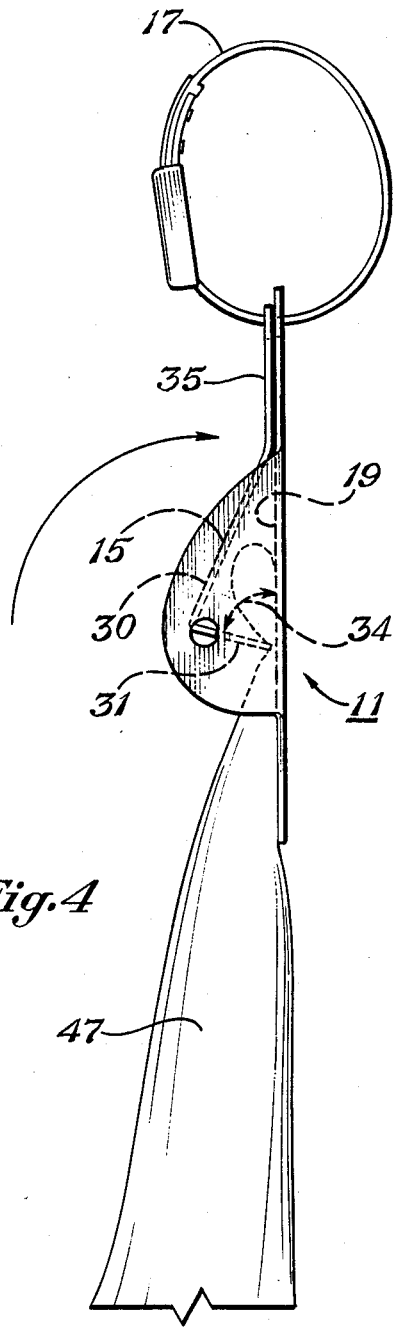
FIG. 4 is a cross-section view of the clasp of the present invention in a clasping position.

With reference now to FIG. 2, the function of clasp 11 will now be described. Clasp 11 serves to couple towel 47 to golf bag 49, or similar object. Tie strap 17 functions to directly couple clasp 11 to the bag. Towel 47 is secured to clasp 11 through the coordinated operation of base 13 and locking member 15. FIGS. 3 and 4 will be used to describe the functional cooperation of base 13 and locking member 15 to grip towel 47.

With reference now to FIG. 3, clasp 11 of the present invention is shown in a loading or open position with maximum clearance 4$ between substantially planar surface 19 of base 13 and gripping edge 31 of locking member 15. When in the loading position, a small portion of towel 47 may be inserted in clearance 45 between base 13 and locking member 15. In order to secure towel 47 in clasp 11, handle 35 is rotated downward through the arc and into interfacing relationship with substantially planar surface 19, as is depicted in FIG. 4.

With reference now to FIG. 4, towel 47 is shown gripped by clasp 11. In this clasping position, handle 35 is flat against substantially planar surface 19 of base 13, while gripping edge 31 forms a nonperpendicular angle with substantially planar surface 19. In this position, gripping edge 31 compresses towel 47 against substantially planar surface 19. Towel 47 is somewhat resilient and creates a force which acts on locking member 15. More specifically, since gripping edge 31 is at a non-perpendicular angle with substantially planar surface 19, and serves in part as a pivot arm which reacts to the upward force of the compressed sponge-like terry cloth towel 47. This force on pivot arm 31 serves to bias locking member 15 in the clasping position, and prevents accidental removal of towel 47 during ordinary use. Furthermore, downward forces exerted on towel 47 during ordinary use serve to reenforce the position of locking member 15. Specifically, downward forces along towel 47 are translated into rotational forces at gripping edge 31, urging locking member 15 into the stable clasping position.

The clasp of the present invention has a variety of advantages over existing systems. First, ordinary towels may be used with this clasp, as opposed to towels having eyelets disposed along one edge for securing to equipment through pins. Second, the towel may be removed from the clip and replaced with maximum ease and convenience. Third, the clasp of the present invention is a self-locking item, which maintains its stability when downward forces are applied to the hand towel during normal use. Fourth, at least one substantially planar surface is provided, which is suitable for custom printing, rendering the hand towel clip of the present invention useful as a speciality advertising item.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A clasp for gripping a towel, comprising:

a base having a substantially planer surface;

a pair of flanges protruding upward from the base, having opposed apertures;

an opening at one end of the base for receiving a strap;

a locking member having a projection means on opposite sides for receipt in the apertures for pivotally mounting the locking member to the flanges for movement between an open position and a closed position;

the locking member having a first portion defining gripping teeth;

the locking member having a second portion extending from the first portion at an angle that is less than 90 degrees and which contacts the planer surface of the base when the locking member is in the closed position;

the locking member having a third portion extending from the second portion parallel to the base planer surface when the locking member is in the closed position;

the third portion having a recess at its end which aligns with the opening in the base plate when the locking member is in the closed position to provide access for the strap extending through the opening;

the locking member defining a first clearance between the planar surface of the base and the first portion when the locking member is in the open position for loading a towel between the locking member and the base;

the locking member defining a second and very small clearance between the gripping teeth and the planer surface of the base plate when the locking member is in the closed position to accommodate towel thickness and to prevent the towel from being pulled from the clasp; and the clasp being adapted to be attached to a golf bag by the strap.

2. The clasp according to claim 1, wherein the recess portion is concave shaped.

3. The clasp according to claim 1 wherein the second and third portions of the locking member join each other at an obtuse angle.

4. The clasp according to claim 1 wherein the teeth have edges which are flat and parallel to the planer surface of the base when the locking member is in the closed position.

5. The clasp according to claim 1 wherein the first, second and third portions of the locking member are integrally formed with each other.

* * * * *